US005970300A

United States Patent [19]

Acquaviva

[11] Patent Number: 5,970,300

[45] Date of Patent: Oct. 19, 1999

[54] APPARATUS FOR APPLYING SCENTS TO PAPER IN A PRINTER/COPIER

[75] Inventor: Thomas Acquaviva, Penfield, N.Y.

[73] Assignee: Xerox Corporation, Stamford, Conn.

[21] Appl. No.: 09/087,945

[22] Filed: Jun. 1, 1998

[51] Int. Cl.[6] ..... G03G 15/20; G03G 21/00

[52] U.S. Cl. ..... 399/341

[58] Field of Search ..... 399/320, 324, 399/341

[56] References Cited

U.S. PATENT DOCUMENTS

| | | | |
|---|---|---|---|
| 4,272,666 | 6/1981 | Collin | 399/324 X |
| 4,836,129 | 6/1989 | Dahlgren | 118/46 |
| 5,264,899 | 11/1993 | Mandel | 355/200 |
| 5,434,029 | 7/1995 | Moser | 430/97 |
| 5,596,930 | 1/1997 | Keller et al. | 101/483 |

FOREIGN PATENT DOCUMENTS

| | | |
|---|---|---|
| 4-16885 | 1/1992 | Japan . |
| 4-154566 | 5/1992 | Japan . |
| 5-107973 | 4/1993 | Japan . |
| 6-295092 | 10/1994 | Japan . |
| 9-136761 | 5/1997 | Japan . |

*Primary Examiner*—Fred L. Braun
*Attorney, Agent, or Firm*—William A. Henry, II

[57] ABSTRACT

A printing apparatus that prints images onto sheets includes a conditioner that scents selected images of a job. For example, the job can be a magazine that advertises a particular fragrance or fragrances. A fragrance or scent is placed in a reservoir which is transferred via a hydrophilic donor-like roll and deposited onto a sheet by way of a nip that is engaged only when scenting is required.

7 Claims, 2 Drawing Sheets

APPARATUS FOR APPLYING SCENTS TO PAPER IN A PRINTER/COPIER

Figure 1:
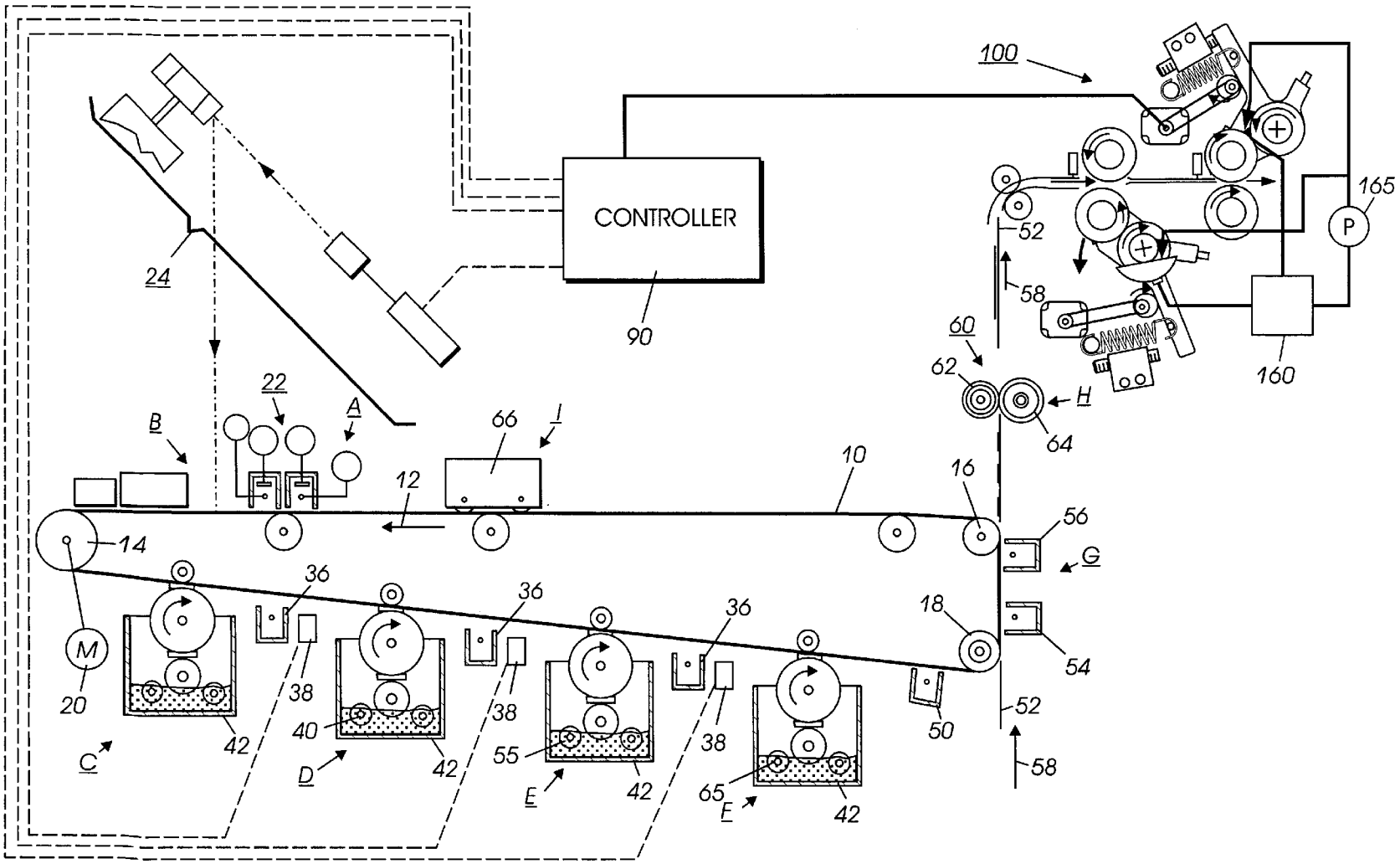

This invention relates generally to a substrate conditioning device for an electrophotographic printing machine and, more particularly, concerns an improvement for adding scents to particular sheets passing through the machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling.

A number of solutions to this problem have been advanced. One proposed solution is disclosed in U.S. patent application Ser. No. 08/808,412, filed Feb. 28, 1997, by Thomas Acquaviva et al. and entitled PAPER CONDITIONER WITH ARTICULATING BACK-UP/ TRANSFER ROLLS which is incorporated herein by reference to the extent necessary to practice the present invention and uses a conditioner located after the fuser and before a mechanical decurler. The function of the conditioner is to replace the moisture lost in the fusing process and thereby reduce image dependent curl. The approach taken to replace moisture is to drive a sheet between two closely spaced rollers: one roller called the back-up roller, is rubber coated and drives the sheet forward. The second roller, called the transfer roller, rotates in the opposite direction and applies a thin film of water to the paper on the side opposite to the back-up roller. The surface of the transfer roller is "wet" by passing through a flooded nip. The film thickness deposited on the transfer roll surface is determined by the pressure between the transfer roller and a metering roll. Two sets of these rollers are required to moisturize both sides of the sheet.

Even though the amount of moisture added back into a sheet as it passes through a conditioner is closely monitored to only replace the moisture lost from a sheet as it passes through a fuser, a need has been shown in the printing industry to add a scent to predetermined pages in various types of magazines, catalogs, and other publications for consumers. Many contain scented page inserts or scented printing inks for advertising perfumes. Xerography has not been able to reproduce these effects since toner is not easily scented. For example, if one were to print onto "scratch and sniff" sheets, the heat and/or high pressure fuser rolls would destroy the scented material. Thus, the need exists for a method and apparatus which allows xerographic reproduction products to image and scent selected sheets in a job whether encompassing individual sheets, bound book or magazine.

The following disclosures may be relevant to various aspects of the present invention:

U.S. Pat. No. 5,434,029

Inventor: Moser

Issue Date: Jul. 18, 1995

U.S. Pat. No. 5,264,899

Patentee: Mandel

Issued: Nov. 23, 1993

Portions of the foregoing disclosures may be briefly summarized as follows:

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aforementioned nip.

U.S. Pat. No. 5,264,899 describes a system for adding moisture to a copy sheet is disclosed. The toner fixation step of electrostatographic reproduction desiccates paper, which may lead to the formation a wave along the sheet edge. The invention uses a pair of porous rolls defining a nip to transfer additional moisture to the copy sheet as it is passed through the nip. The added moisture prevents edge wave formation.

In accordance with one aspect of the present invention, there is provided a device for adding moisture to a copy sheet. The device comprising a reservoir for storing a quantity of scented water or liquid aromatic, a pair of generally cylindrical rolls, each having an outer cylindrical surface, said rolls being aligned with respect to one another along their axes so as to define a closely spaced nip between said outer cylindrical surfaces, a metering device in circumferential surface contact with one of said rolls for controlling the flow of fluid from the reservoir to at least one of said rolls.

Figure 2:
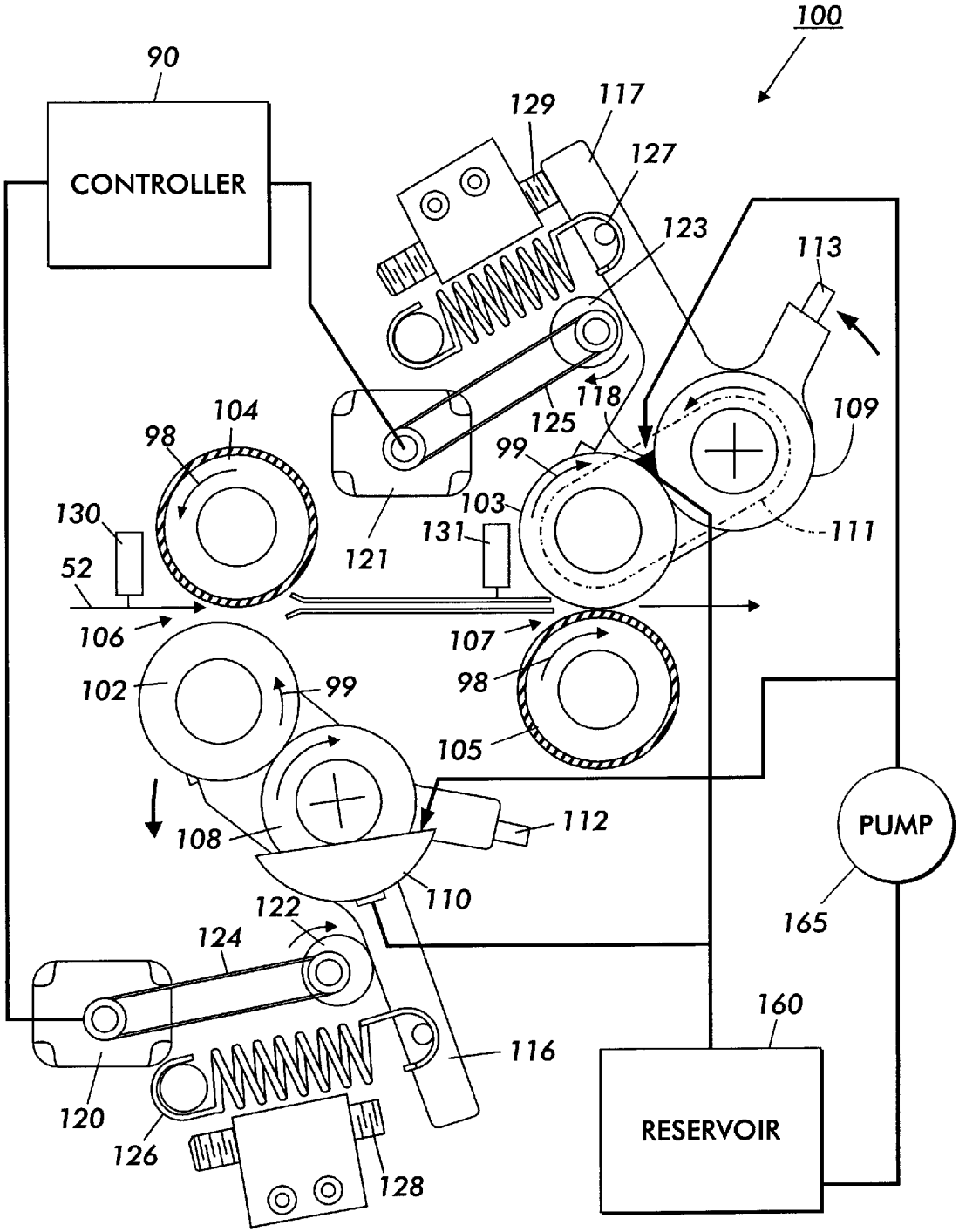

Other features of the present invention will become apparent as the following description proceeds and upon reference to the drawings, in which:

FIG. 1 is a schematic elevational view of a full color image-on-image single pass electrophotographic printing machine utilizing the scent adding device described herein; and FIG. 2 is a detailed elevational side view of the scent adding device.

This invention relates to an imaging system which is used to produce color output in a single revolution or pass of a photoreceptor belt and to add a scent to selected portions of the color output. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Turning now to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension roller 16 and fixed roller 18, and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably, the scanning device is a laser Raster Output Scanner (ROS). Alternatively, the ROS could be replaced by other xerographic exposure devices such as LED arrays.

The photoreceptor, which is initially charged to a voltage $V_O$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a non-contact type in which only toner particles (lack, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HJD developer system. A power supply (not shown) serves to electrically bias the developer structure to a level effective to develop the discharged image areas with negatively charged yellow toner particles 40.

The above procedure is repeated for a third imager for a third suitable color toner such as magenta at developer station E and for a fourth imager and suitable color toner such as cyan at developer station F. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pretransfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. Sheet 52 is advanced through scenter 100 and thereafter to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

Aromography, which term is used herein to mean the addition of one or more fragrances to sheets is enabled with scenter apparatus 100, in accordance with the present invention, which apparatus is placed at some location along the paper path, and preferably, between the fuser and output device. It applies a very small amount of scented water or liquid aromatic to a predetermined sheet in accordance with instructions programmed into controller 90. A scent can be added to a whole sheet, selected portions of a sheet, both sides of a sheet, or selected portions of both sides of a sheet. In addition, scenter apparatus 100 has the capability of different scents to each side of a sheet, for example, lemon on one side and lime on the other. In practice, a fragrance could be added to the water supply reservoir 160 of the apparatus which is pumped by pump 165 to moisturizing rolls with metering of the rolls of the scented water adjusted to only provide enough to scent the sheet, but not enough to cause curl.

As shown in FIG. 2, the scenter apparatus, generally referred to as reference numeral 100, has transfer rollers 102, 103 rotating in the dircetion of arrows 99 which are articulated in an almost vertical direction, such that when the lead edge of incoming sheets 52 enter the nip areas 106, 107, the transfer rollers 102, 103 move towards the sheet 52. In this closest position, the transfer rollers 102, 103 are about 0.002 inches from the rotating back-up rollers 104, 105 which are in a fixed position. Likewise, when the trail edge of the sheet is about to exit the nips 106, 107, the transfer rollers 102, 103 move away from the sheet 52 to disengage the back-up rollers 104, 105. Springs 126, 127 provide the normal force for the transfer rollers 102, 103 against back up rollers 104, 105. Since the back-up rollers 104, 105 are rubber coated, a thick or thin sheet will deflect the rubber surface and provide the necessary drive force. The roller nips 106, 107 are disengaged in the intercopy gap, by say 0.015", and there is no danger that the back-up rollers 104, 105 will be wet.

The wetting agent, in this case water, is distributed to the transfer rolls 102, 103 from sumps 110, 111 by way of metering rolls 108, 109. A fragrance is added to the water to give the desired scent to selected sheets. The contact between the metering rolls 108, 109 and the transfer rolls 102, 103 can be adjusted by using adjuster screws 112, 113 which can be manually adjusted as shown, or the adjusters 112, 113 can be driven by a motor (not shown) or other device to provide automatic adjustment depending on the desired film thickness on the transfer roller.

The amount of scented wetting agent applied to each surface is a function of the relative velocity between the sheet and transfer rollers 102, 103 which rotate in the opposite direction from back up rollers 104, 105 which are rotating in the direction of arrows 98. To apply no scent to a sheet, the transfer rollers 102, 103 are stopped.

A sensor 130 located upstream of the first moisturizing nip 106, detects lead and trail edge sheet position and provides the necessary timing to close and open the nips 106, 107. For example, if the sheet velocity when it is at the sensor 130, and the distance from the sensor 130 to each moisturizing nip 106, 107 are known, and the velocity between nips and sheet velocity in each nip is known, then it is a relatively simple algorithm to determine when to engage and disengage each nip. Alternately, a second sensor 131 can be used between the nips 106, 107 to assist in determining the proper sequencing of the nip engagement/disengagement.

There is illustrated only one of many methods of separating the nips 106, 107. In FIG. 2, there is shown two stepper motors 120, 121 driving two cams 122, 123. As each cam 122, 123 rotates in the clockwise direction, it separates the respective transfer roller 102, 103 from the respective back-up roller 104, 105. In the position illustrated by the cam 122, the nip 106 may be separated by 0.015". When the cams are in the position illustrated by cam 123, the cam surface is not touching the pivot arm 117, but the contact dimension is determined by the adjustment screw 129. In the position illustrated by the cam 123, the nip 107 may be separated by 0.002 inch. A similar screw 128 is provided for arm 116. This scheme uses two stepper motors 120, 121 driving cams 122, 123 through drive members 124, 125. Alternate methods might employ solenoids, clutches, cables etc. Likewise, alternate methods might articulate the back-up rollers 104, 105 instead of the transfer rollers 102, 103. In a magazine job, the unscented sheets would be transported through the moisturizing nip without touching the rollers. When controller 90 calls for a scented sheet, the moisturizing roller nip would close and the scented water would be applied to the sheet. In this manner, only the selected portions of the sheet would be scented.

Wetting agent leakage prevention employed with the upper transfer roll 103/metering roll 109 assembly to ensure that the wetting agent is prevented from dripping onto the sheet and producing undesirable wetting characteristics. The wetting agent leakage prevention system includes a liquid dam 118 in combination with metering roll 109 and transfer roll 103 to provide a flooded nip.

In recapitulation, there is provided a scenter apparatus that applies a scented liquid to selected sheets to produce specialty documents, such as, consumer magazines. The amount of liquid added will not adversely affect an image on a sheet or curl.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A device for adding scented moisture to a copy sheet, comprising:

a reservoir;

a quantity of scented liquid stored in said reservoir;

a pair of cylindrical rolls, each having an outer cylindrical surface, said rolls being aligned with respect to one another along their axes so as to define a nip between said outer cylindrical surfaces;

a metering roll including a circumferential surface in contact with one of said rolls for controlling the flow of scented liquid from said reservoir to at least one of said rolls; and a controller for selectively deactuating one of said pair of cylindrical rolls when scenting of a copy sheet is not required.

2. The device according to claim 1, wherein said cylindrical roll pair comprises;

a first roll having an elastomeric coating to drive a sheet in a first direction through the nip; and a second roll, for applying said scented liquid to a side of the sheet opposite the side that contacts said first roll, said second roll having a smooth outer cylindrical surface, wherein said second roll rotates in a direction opposite the direction of said first roll.

3. The device according to claim 2, including a controller and wherein said controller controls the application of said scented liquid to predetermined portions of the sheet.

4. The device of claim 1, wherein scented liquid of a different fragrance is added to opposite sides of copy sheets.

5. A sheet scenting system, comprising:

at least one pair of cylindrical rolls, said rolls being aligned with respect to one another along their axes so as to define a closely spaced nip between outer surfaces thereof;

at least one metering roll having a circumferential surface in contact with one of said rolls for forming a nip therewith and controlling the amount of fluid supplied to said one of said rolls;

a reservoir;

a quantity of scented liquid stored in said reservoir;

a pump for supplying said scented liquid from said reservoir to the nip formed between said at least one metering roll and said one of said rolls; and a controller for selectively controlling rotation of one of said at least one pair of cylindrical rolls depending on whether scenting of the sheet is required.

6. The sheet scenting system of claim 5, wherein scented liquid of a different fragrance is added to opposite sides of copy sheets.

7. A printing apparatus that places page image information onto copy sheets includes an apparatus for adding scented moisture to the copy sheets before they exit the printing apparatus, comprising:

a reservoir;

a quantity of scented liquid stored within said reservoir;

a pair of cylindrical rolls, each having an outer cylindrical surface, said rolls being aligned with respect to one another along their axes so as to define a closely spaced nip between said outer cylindrical surfaces;

a metering roll including a circumferential surface in contact with one of said rolls for controlling the flow of liquid from said reservoir to said one of said rolls; and a controller for stopping one of said pair of cylindrical rolls from rotating in order to prevent scenting of the copy sheets.

* * * * *